United States Patent [19]

Bayer

[11] Patent Number: 4,646,054

[45] Date of Patent: Feb. 24, 1987

[54] THERMAL SWITCH

[75] Inventor: Helmut Bayer, Vienna, Austria

[73] Assignee: Electrovac, Fabrikation Elektrotechnischer Spezialartikel GmbH, Vienna, Austria

[21] Appl. No.: 743,945

[22] Filed: Jun. 12, 1985

[30] Foreign Application Priority Data

Jun. 15, 1984 [AT] Austria ..... 1966/84

[51] Int. Cl.[4] ..... H01H 37/70; H01H 37/52

[52] U.S. Cl. ..... 337/348; 337/342; 337/356; 337/367

[58] Field of Search ..... 337/348, 66, 343, 356, 337/363, 56, 380, 342, 347, 349, 351, 354, 365, 337/367, 372, 374, 375

[56] References Cited

U.S. PATENT DOCUMENTS 4,092,623 5/1978 Kirkup ..... 337/66

4,554,525 11/1985 Bayer ..... 337/348

*Primary Examiner*—Harold Broome

*Attorney, Agent, or Firm*—Marmorek, Guttman & Rubenstein

[57] ABSTRACT

A thermal switch for breaking an electrical circuit to prevent overheating is described. The thermal switch includes a bimetallic thermocouple in the form of a snap disc and a leaf spring. The leaf spring supports an electrical contact. When the leaf spring is in its stressed position, the electrical contact keeps an electrical circuit closed. When the temperature rises too high, the snap disc snaps in a direction which causes the leaf spring to move into its unstressed position, thereby opening the circuit. When the temperature has decreased, the switch can be reset.

6 Claims, 2 Drawing Figures

THERMAL SWITCH

This invention relates to a thermal switch having a temperature sensor in the form of a bimetallic thermocouple designed as a snap disc. The temperature sensor cooperates with an electrical contact system having at least one movable contact which is maintained in electrical contact with at least one fixed contact by means of a spring when in the usual resting position.

In Austrian Pat. No. 374,619, a thermal switch is described consisting of, in substance, a bimetallic thermocouple in the form of a snap disc located on the bottom of a compartment, which disc cooperates with an electrical contact system by means of a vertical, cylinder-shaped transfer member. This contact system consists of a contact bridge and two connecting flags whose ends, turned inward, form two rigid contacts. In the resting position, the flags are linked to each other through movable contacts forming a contact bridge. This contact bridge is pressed against the connecting flags by means of a hairpin-shaped leaf spring. The leaf spring, together with the contact bridge, form a contact carrier that supports the movable contacts. A locking member having a cylindrical shape presses against the front side of the contact carrier under the action of another spring. When the leaf spring is raised from the connecting flags through movement of the thermo-bimetallic snap disc with the resulting displacement of the transfer member, the spring movement is supported by the circular crescent shaped surface of the locking member and the therewith connected leaf spring.

It is the object of the present invention to provide a thermal switch of a similar nature which is simpler to operate and more reliable. This object, according to the invention, is achieved by providing the contact carrier in the form of a leaf spring biased in a direction perpendicular to the snap direction of the bimetallic thermocouple in the form of a snap disc.

With such a simple, uncomplicated construction, expenses are reduced but without in any way impairing the efficiency of operation. In addition, setting the leaf spring into its prestressed condition is relatively simple. With this simple construction requiring simple components which are uncomplicated to manufacture, an especially high degree of efficiency of operation is assured.

Another advantageous embodiment of the invention is achieved by providing a setting lug in the switch compartment at the free end of the leaf spring.

Such setting means are easy to manufacture and enable prestressing of the leaf spring upon manufacture of the thermal switch. Prestressing can easily be accomplished without tools by leading the leaf spring over the inclined surface of the lug. As soon as the thermo-bimetallic snap disc is activated due to undesirably high heating and snaps in the direction of the leaf spring, the free end of the leaf spring is lifted over the lug. The leaf spring then moves perpendicularly to the snapping direction of the snap disc, thus releasing the prestressing condition and breaking the electrical circuit.

An especial advantage of using a lug to anchor the leaf spring is that under normal conditions there exists a complete separation of th leaf spring and the thermo-bimetallic snap disc. Thus, no outside forces are transferred between the parts, e.g., there do not arise any frictional forces which might influence the efficiency of operation and which would normally arise under the influence of the temperatures affecting the bimetallic snap disc.

Another advantageous embodiment of the invention consists in forming the leaf spring in one piece and affixing it to the switch compartment by one leg. Furthermore, the broad side of the leaf spring is arranged in parallel to the snapping direction of the thermo-bimetallic snap disc.

In view of the unitary construction of the leaf spring, a tight connection with the switch compartment is achieved. By means of such connection, the torsion forces arising over the setting lug during the prestressing process, i.e., upon snapping of the thermo-bimetallic snap disc, are distributed in an optimal way.

Finally, in another advantageous embodiment of the invention, an insulating body is arranged on the side of the leaf spring that is turned away from the thermo-bimetallic snap disc and a contact piece is arranged on the insulating body.

This direct arrangement of the contact piece on the leaf spring, in an embodiment of simple construction, also ensures a contact that is free from disturbances.

In the following paragraphs, the invention will be explained in more detail making reference to the embodiment illustrated in the drawing.

Figure 2:
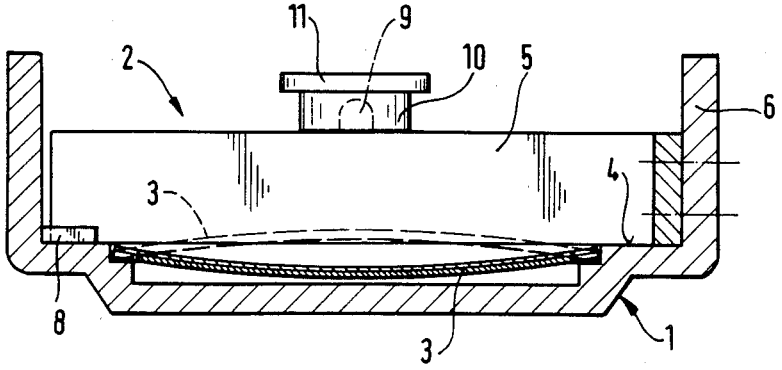
FIG. 2 is a sectional view along line II—II of FIG. 1.

Referring to the drawings, a switching compartment 1 with a thermal switch 2 are shown. As shown in FIG. 2, thermal switch 2 is generally U-shaped. A bimetallic thermocouple in the form of a snap disc 3 is located in the bottom area of switching compartment 1. Snap disc 3, when in its normal resting position, has a concave shape, as illustrated in FIG. 2 in the full line. A leaf spring 5 formed in one piece rests on an intermediate surface 4 of switching compartment 1. Leaf spring 5 is affixed to the vertical side wall 6 of the switching compartment 1 by riveting, soldering, welding or similar processes.

Figure 1:
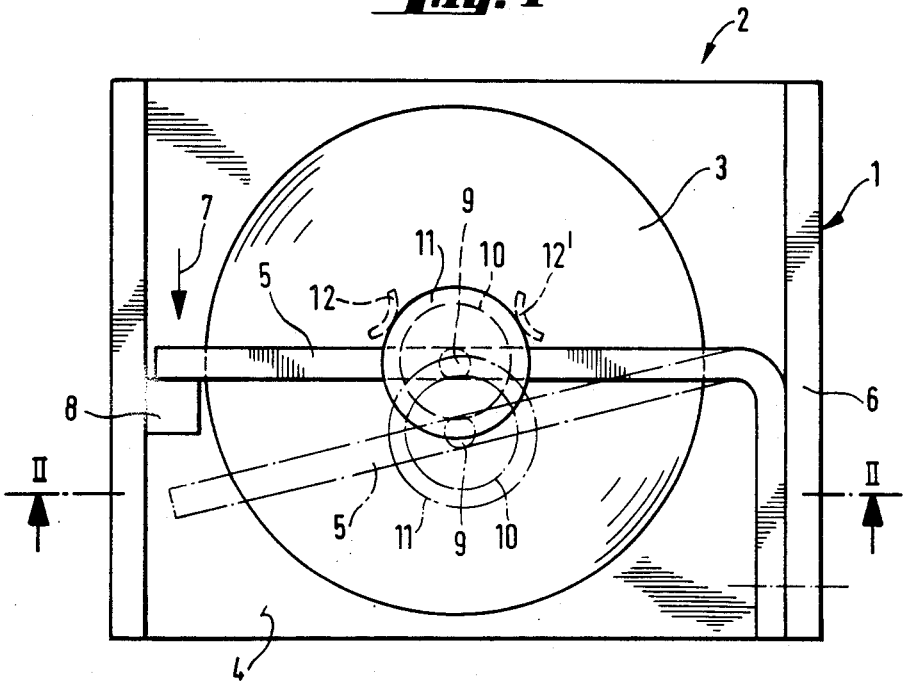
FIG. 1 is a greatly enlarged top view of a thermal switch constructed according to the present invention.

In the position illustrated in FIG. 1 by a full line, the leaf spring 5 is in its stressed condition and presses in the direction shown by arrow 7 against setting lug 8 affixed to the bottom of the switching compartment. Lug 8 is in the form of a ramp rising in the direction of leaf spring 5 in its stressed position.

On the upper ledge of leaf spring 5 there is provided an extension 9 (FIG. 2) on which there is provided a cylindrically shaped insulating body 10. On the insulation body 10, there is provided a contact piece 11 that conducts electricity. Contact piece 11 is designed to abut against two fixed counter-contacts 12 and 12' (FIG. 1), thereby forming a path for voltage to pass through comprising counter-contact 12, contact piece 11, and counter-contact 12'. Counter-contacts 12 and 12', which in the usual position abut against electrically conducting contact piece 11, have been illustrated in dotted lines.

As soon as there occurs an undesirably high heating of a device to which this switch is connected, for example, as may occur in an iron upon failure of the temperature regulator, the arch-shaped thermo-bimetallic snap disc 3 warms up and snaps upwards into the position represented by the dotted line in FIG. 2. As a result of this snapping movement, the free end of leaf spring 5 is lifted over the height of setting lug 8 so that the leaf spring with its free end assumes the unstressed position shown by dash-dotted lines in FIG. 1. Simultaneously with this spring movement, the contact piece 11 atop leaf spring 5 is moved away from contacts 12 and 12' so that the voltage supply to the device is interrupted.

Restablishment of the voltage supply is especially easy in a thermal switch constructed according to the present invention. After the device has cooled off and the thermo-bimetallic snap disc 3 has returned to the position illustrated by a full line in FIG. 2, the free end of the leaf spring 5 is slid back across the inclined surface of the ramp-shaped setting lug 8 until the leaf spring 5 again latches into the position represented by a full line in FIG. 1 and comes to lie on intermediate plane 4.

I claim:

1. A thermal switch for breaking an electrical circuit to prevent overheating, comprising a switch compartment, a bimetallic thermocouple capable of displacement in response to temperature in said switch compartment, a leaf spring having a leg capable of movement between a stressed and an unstressed position, said movement of said leg being in a plane perpendicular to the direction of displacement of said thermocouple, a movable contact mounted on said leg of said leaf spring, and a second contact in electrical contact with said movable contact when said leg is in its stressed position, said second contact not being in electrical contact with said movable contact when said leg is in its unstressed position, whereby said thermocouple causes said leg of said leaf spring to move into its unstressed position and break the electrical contact between said first and second contacts when the temperature rises above a predetermined value.

2. The thermal switch of claim 1 wherein said thermocouple is in the form of a snap disc.

3. The thermal switch of claim 2 further comprising a setting lug for retaining said leg of said leaf spring in its stressed position.

4. The thermal switch of claim 2 wherein said leaf spring is of unitary construction and further comprises a second leg affixed to said switching compartment, wherein the direction of movement of said first leg is substantially parallel to the plane of said snap disc.

5. The thermal switch of claim 2 further comprising an insulation body mounted on said leaf spring, said insulation body supporting said movable contact.

6. The thermal switch of claim 2 wherein the plane formed when electrical contact between said first and second contacts is broken is perpendicular to the direction of displacement of said thermocouple.

* * * * *